US008469769B2

(12) United States Patent
Hendrickson

(10) Patent No.: US 8,469,769 B2
(45) **Date of Patent: *Jun. 25, 2013**

(54) NURSING GARMENT AND METHOD OF MAKING

(75) Inventor: Lisa A. Hendrickson, Mount Laurel, NJ (US)

(73) Assignee: Destination Maternity Corporation, Philadelphia, PA (US)

( * ) Notice: Subject to any disclaimer, the term of this patent is extended or adjusted under 35 U.S.C. 154(b) by 913 days.

This patent is subject to a terminal disclaimer.

(21) Appl. No.: 12/575,769

(22) Filed: Oct. 8, 2009

(65) Prior Publication Data

US 2010/0068971 A1 Mar. 18, 2010

Related U.S. Application Data

(63) Continuation-in-part of application No. 12/497,901, filed on Jul. 6, 2009, now Pat. No. 8,226,452, which is a continuation-in-part of application No. 12/108,960, filed on Apr. 24, 2008, now Pat. No. 7,878,881.

(51) Int. Cl.
*A41C 3/00* (2006.01)

(52) U.S. Cl.
USPC ..... 450/30; 450/33

(58) Field of Classification Search
USPC ..... 450/30–32, 53, 55–57, 36, 37, 10–13, 450/15, 16, 18, 20, 23; 2/73, 113–115, 104, 2/105, 106
See application file for complete search history.

(56) References Cited

U.S. PATENT DOCUMENTS

| | | | |
|---|---|---|---|
| 4,355,641 | A | 10/1982 | Dastoli et al. |
| 4,494,388 | A | 1/1985 | Lau et al. |
| 4,583,544 | A | 4/1986 | Flanagan et al. |
| 5,149,336 | A | 9/1992 | Clarke et al. |
| 5,461,725 | A | 10/1995 | Witczak |
| 5,611,086 | A | 3/1997 | Eggen |
| 5,652,049 | A | 7/1997 | Suzuki |
| 5,944,579 | A | 8/1999 | Fleischmen |
| 6,276,175 | B1 | 8/2001 | Browder, Jr. |
| 6,374,643 | B2 | 4/2002 | Orima |
| 6,550,067 | B2 | 4/2003 | Force |

(Continued)

FOREIGN PATENT DOCUMENTS

| | | |
|---|---|---|
| DE | 200 14 080 U1 | 12/2000 |
| WO | WO2009/033028 | 12/2009 |

OTHER PUBLICATIONS

Settlement Agreement, *Rothman* v. *Target*, Civ. Act. No. 05-4829, Oct. 2007, pp. 1-19.

*Primary Examiner* — Gloria Hale
(74) *Attorney, Agent, or Firm* — DLA Piper LLP (US)

(57) ABSTRACT

A nursing garment and method manufacture thereof includes, detachable portions of nursing clips to connect a built-in bra to shoulder straps, wherein the built-in bra is detachable from either one of the shoulder straps in preparation for nursing and is without openings for nursing. In further embodiments: the shoulder straps include sling supports behind the built-in bra; a garment bottom portion either unlined or lined with a stretchable lining; a knitted bottom portion joined at a junction with a knitted outer bodice and its knitted inner panel; and another embodiment includes, first clasps and second clasps of hermaphroditic mating construction, wherein the second clasps on the shoulder straps connect with either of the first clasps on the outer bodice, or alternatively, connect with each other.

41 Claims, 11 Drawing Sheets

U.S. PATENT DOCUMENTS

| | | | | |
|---|---|---|---|---|
| 6,685,534 | B2 | 2/2004 | Mitchell et al. | |
| 6,685,535 | B2 | 2/2004 | Mitchell | |
| 6,723,428 | B1 | 4/2004 | Foss et al. | |
| 6,839,908 | B2 | 1/2005 | Schneider et al. | |
| 6,854,132 | B1 | 2/2005 | Polzin | |
| 6,855,029 | B2 | 2/2005 | Rothman | |
| 6,899,591 | B2 | 5/2005 | Mitchell | |
| 6,983,489 | B2 | 1/2006 | Caprio | |
| 7,033,244 | B1 | 4/2006 | Barton | |
| 7,051,557 | B2 | 5/2006 | Mitchell et al. | |
| 7,076,809 | B2 | 7/2006 | Rothman | |
| 7,077,720 | B2 | 7/2006 | Schneider et al. | |
| 7,081,034 | B1 | 7/2006 | Zoellner | |
| 7,163,432 | B2 | 1/2007 | Mitchell et al. | |
| 7,192,409 | B2 | 3/2007 | Lorenzo | |
| 7,328,595 | B2 | 2/2008 | Lonati et al. | |
| 7,396,272 | B1 | 7/2008 | Newlen | |
| 7,430,883 | B2 | 10/2008 | Sorensen | |
| 7,448,090 | B2 | 11/2008 | Lucock | |
| 7,448,936 | B1 | 11/2008 | Kemp-Dorsey | |
| 7,488,234 | B2 | 2/2009 | Rothman et al. | |
| 7,546,751 | B2 | 6/2009 | Lutz | |
| 7,878,881 | B2 * | 2/2011 | Hendrickson | 450/36 |
| 8,226,452 | B2 * | 7/2012 | Hendrickson | 450/30 |
| 2006/0277948 | A1 | 12/2006 | Sorensen | |

* cited by examiner

NURSING GARMENT AND METHOD OF MAKING

CROSS REFERENCE TO RELATED APPLICATIONS

This application is a continuation in part of U.S. application Ser. No. 12/497,901 filed Jul. 6, 2009, now U.S. Pat. No. 8,226,452, issued Jul. 24, 2012, the subject matter of which is incorporated herein by reference. This application is a continuation in part of U.S. application Ser. No. 12/108,960 filed Apr. 24, 2008, now U.S. Pat. No. 7,878,881, issued Feb. 1, 2011, the subject matter of which is incorporated herein by reference.

FIELD OF THE INVENTION

The invention relates to a nursing and support clothing to provide ease of entry in preparation for nursing a baby and to provide midsection shape control.

BACKGROUND

U.S. Pat. No. 7,081,034 discloses a nursing bra wherein bra cups are detachably connected to shoulder straps, while bottoms of the bra cups remain connected to a torso strap surrounding a girth of a wearer.

U.S. Pat. No. 6,550,067 discloses an outerwear garment having openings therethrough for nursing. A built-in bra has further openings therethrough for nursing. The neckline on the garment remains in place on the torso and interferes with desired opening of the garment in preparation for nursing.

U.S. Pat. No. 6,983,489 discloses a nursing garment having breast retention panels constructed with two layers of fabric. An inner layer contains openings to insert breast cups. An outer layer provides an outer covering. The two layers are sewn together to form a pocket with an opening on the body side to provide access for receiving a pad.

U.S. Pat. No. 7,076,809 discloses a nursing garment having internal and external, nursing flaps attached by respect respective fasteners to a shoulder strap. A built-in nursing bra is provided by internal sections comprising an elastic chest band, a soft cup frame, the internal nursing flaps, and a back piece of fabric. The internal fabric and flap can also have a pocket made of netting or made of fabric material to hold a nursing pad in place. The fasteners may include snaps, clasps or a hook and loop type fastener, in order to hold the internal and external fabric flaps, which cover the breasts and the soft cup frame.

U.S. Pat. No. 5,461,725 discloses a garment featuring stretchable, resilient straps and a bodice. The straps are sufficiently resilient and suitably stretchable. Straps and bodice are resilient. The bodice has a resilient, stretchable bottom and a resilient, stretchable shining on the front of the bust. The shoulder straps stretch when the bodice is pulled down to nurse an infant. The front shirring and the stretchable bottom cooperatively form a cup conforming to a breast of a wearer of the garment. A removable breast pad is attached on the inner surface of a cup using snap fasteners.

U.S. Pat. No. 6,983,489 discloses a nursing garment having breast retention panels constructed with two layers of fabric. An inner layer contains openings to insert breast pads. An outer layer provides an outer covering. The two layers are sewn together to form a pocket with an opening on the body side to provide access for receiving a pad.

U.S. Pat. No. 7,076,809 discloses a nursing garment having internal and external nursing flaps attached by respect respective fasteners to a shoulder strap. A built-in nursing bra is provided by internal sections comprising an elastic chest band, a soft cup frame, the internal nursing flaps, and a back piece of fabric. The internal fabric and flap can also have a pocket made of netting or made of fabric material to hold a nursing pad in place. The fasteners may include snaps, clasps or a hook and loop type fastener, in order to hold the internal and external fabric flaps, which cover the breasts and the soft cup frame.

Nursing women need garments that provide support to the breast area as well as an easy access to the breasts for nursing. They also are concerned with their overall body shape after pregnancy and are often looking for shape-wear to help smooth their figures. These two problem areas are not usually solved by one garment, which means that a woman needs to wear a nursing bra under a shape-wear top. This can be bulky and make it harder to nurse.

Currently a woman would need to wear three different items of clothing at the same time to help solve her nursing issues. She would need a nursing bra, a shape-wear top to control the midsection, and an outer layer garment that provides body coverage for modesty. Wearing three different items of clothing at one time while nursing, hinder the access to the breasts for nursing and makes it difficult for the woman to position a baby for nursing. The three articles of clothing worn at the same are bulky and the nursing mother can feel hot and uncomfortable. A need exists for a garment providing an easy entry function for nursing a baby, as well as, a support piece of clothing that offers a form of shape-wear clothing for midsection control, and can be worn under an outerwear garment that provides garment coverage for modesty.

SUMMARY OF THE INVENTION

A nursing garment and method manufacture thereof includes, detachable portions of nursing clips to connect a built-in bra to shoulder straps, wherein the built-in bra is detachable from either one of the shoulder straps in preparation for nursing and is without openings for nursing. In further embodiments: the shoulder straps include sling supports behind the built-in bra; a garment bottom portion either unlined or lined with a stretchable lining; a knitted bottom portion joined at a junction with a knitted outer bodice and its knitted inner panel; and another embodiment includes, first clasps and second clasps of hermaphroditic mating construction, wherein the second clasps on the shoulder straps connect with the first clasps on the outer bodice, or alternatively, connect with each other, and another embodiment includes a nursing clip for a nursing garment having a first portion connecting a shoulder strap of a nursing garment to a sling support of the nursing garment, and having a detachable second portion to fasten a built-in bra of the nursing garment to the first portion, wherein the built-in bra is unfastened from the first portion in preparation for nursing by detaching the second portion from the first portion. An embodiment of the nursing garment includes, a built-in bra having an outer bodice, an inner panel for soft cups; shoulder straps connected to a back of the nursing garment, wherein the shoulder straps include sling supports connected to a front of the garment to hold the garment up; and the built-in bra is detachable from a detachable connection to each of the shoulder straps in preparation for nursing.

Another embodiment of the nursing garment includes, a built-in bra having an outer bodice and an inner panel for soft cups therebetween; shoulder straps connected to a back of the nursing garment, wherein the shoulder straps extend behind the soft cups and connect to a front of the nursing garment behind the built-in bra; and the outer bodice and the inner panel and the soft cups are without openings therethrough for nursing, and top ends of the built-in bra are connected by detachable fasteners to respective shoulder straps wherein each of the top ends of the built-in bra is detachable from one of the respective shoulder straps in preparation for nursing.

Another embodiment of the nursing garment includes, a built-in bra having an outer bodice and an inner panel for soft cups therebetween; shoulder straps connected to a back of the nursing garment, and the shoulder straps are connected to a front of the garment, to hold the garment up; respective first clasps and respective second clasps of hermaphroditic mating construction, wherein the respective first clasps are attached to the outer bodice and face in a same first direction for connection to the respective second clasps, and wherein the respective second clasps are attached to the shoulder straps and face in a same second direction opposite the first direction to connect to either of the respective first clasps; and the built-in bra is detachable from a detachable connection to each of the shoulder straps in preparation for nursing.

An embodiment of a method making a nursing garment includes, knitting simultaneously an outer bodice and an inner panel inside the outer bodice for soft cups therebetween and provide a built-in bra; assembling an edge binding with detachable portions of nursing clips and sewing the edge binding to join tops of the outer bodice and the inner panel to connect the built-in bra to the detachable portions of the nursing clips; sewing sling supports to the garment; and connecting respective sling supports and respective shoulder straps with portions of the nursing clips to which the detachable portions of the nursing clips attach. Another embodiment of the method includes, knitting a seamless tubular bottom portion; and knitting a junction of the seamless tubular bottom portion with the outer bodice and the inner panel. Another embodiment of the method includes, attaching a lining of the seamless tubular bottom portion to the interior of the junction. Another embodiment of the method includes, attaching first clasps to a back of the outer bodice; and attaching second clasps to respective shoulder straps, wherein the first clasps and the second clasps are of hermaphroditic mating construction to connect the second clasps either with respective first clasps or with each other.

BRIEF DESCRIPTION OF THE DRAWINGS

Embodiments of the invention will now be described by way of example with reference to the accompanying drawings.

DETAILED DESCRIPTION

Figure 1:
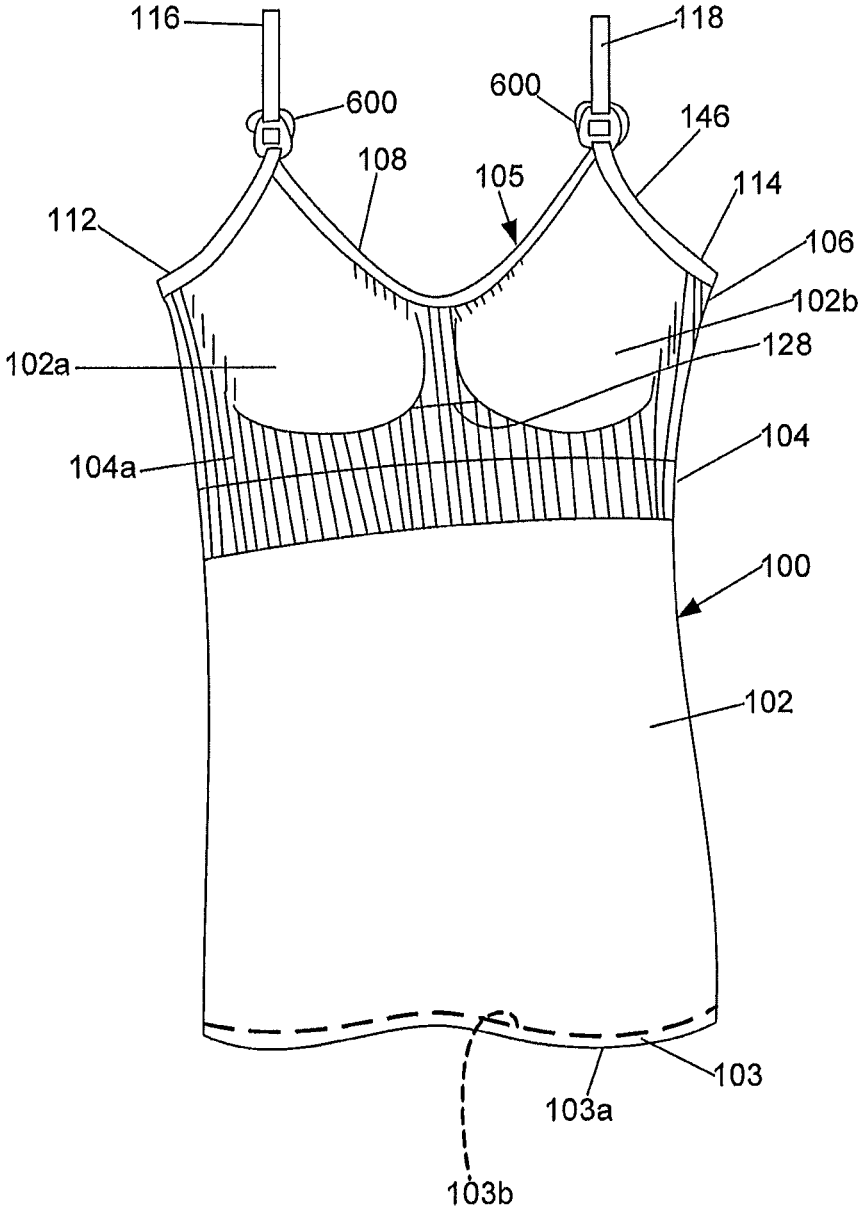
FIG. 1 is a front view of an outerwear garment for nursing having a built-in bra without openings therethrough for nursing, and providing shape-wear clothing for midsection smoothing and support.

FIG. 1 discloses a nursing garment 100 for nursing or breast-feeding an infant. A knitted or woven bottom portion 102 has a bottom hem 103 knitted or woven with a turn back fold 103*a*, such that the bottom hem 103 is turned back inside the bottom portion 102 forming a tubular bottom hem 103. An edge of the bottom hem 103 is turned back, and is knitted or seamed with an anchoring edge stitch 103*b* to join the edge of the bottom hem 103 to the inside of the bottom portion 102. The garment 100 is open at the bottom.

As disclosed by FIG. 1, the bottom portion 102 extends downwardly from a chest band 104. An embodiment of the chest band 104 rises upward to a peak located at center front of the outer bodice 106 to position the bra-like support under the wearer's breasts. The peak is a rounded peak or a pointed peak. Preferably the chest band 104 is a resiliently stretchable and contractible elastic band, woven or knitted with spandex or elastane fibers, such as LYCRA® fibers in a rib stitch. The extra spandex or elastane fibers provides elastic support under the wearer's breasts to serve as a bra support. An embodiment of the chest band 104 extends approximately straight across the torso to position the bra-like support under the wearer's breasts.

The chest band 104 stretches to enlarge its circumference for a wearer to put on or remove the garment 100. While the garment 100 is worn, the chest band 104 conforms to the torso of wearer of the garment 100. The chest band 104 is stretchable moderately while being worn to provide a bra-like support under the wearer's breasts.

Figure 3:
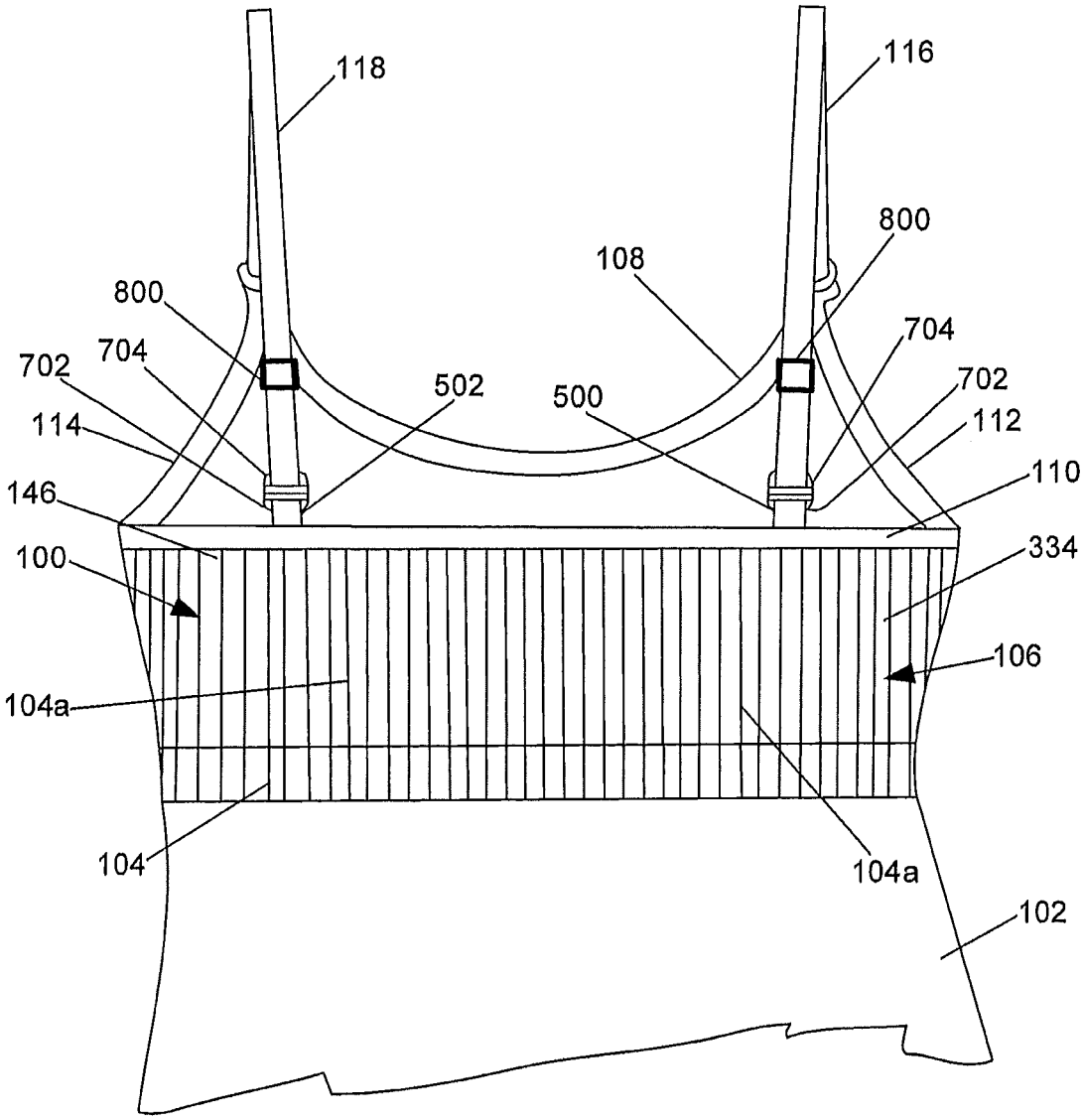
FIG. 3 is a fragmentary view of shoulder straps and a back of the garment disclosed by FIG. 1.

Further in the embodiment of FIG. 1, the top of the outer bodice 106 has a front neckline 108 and a back neckline 110, FIG. 3, or top edge of the garment. The top of the outer bodice 106 has underarm sections 112 and 114 defining arm holes or arm-receiving openings of the garment, which are edge trimmed with a facing reinforcement or edge binding 146, for example, a rolled-edge fabric reinforcement that reinforces an edge of the garment fabric, while being comfortable to the touch against a wearer's skin. The back neckline 110 can project close to the neck of a wearer, or can project downward to provide a substantially backless appearance.

The nursing garment 100 provides a fashion undergarment, and which alternatively can be worn under an outer garment top including, but not limited to a shirt or blouse, sweater or jacket. The nursing garment 100 is constructed for breast-feeding a nursing infant and can be worn as an outerwear garment including but not limited to a camisole top or sleepwear. The outer bodice 106 is knitted or woven with a smooth appearance covering the breasts of the wearer. The knitted or woven fibers of smooth cup portions 102*a*, 102*b* of the outer bodice 106 stretch about the breasts of the wearer with a moderate amount of resilient recovery. The fabric of the outer bodice 106 is substantially continuous over the chest and is without openings for nursing, to provide a smooth, one-piece appearance covering the breasts. The outer bodice 106 includes a continuous seamless stretch body that extends upward from the torso midriff and forms the outer layer of the garment to give a smooth appearance. The knitted embodiment of the invention, using seamless knitting technology, provides a shapewear camisole combined with a built-in bra 105 and a clip-down nursing function so that the customer is only wearing one item of clothing under her outerwear top. The seamless technology also offers a more comfortable alternative to a standard bra construction by eliminating the need for back hooks to get on and off the body. The different fashioning stitches and tighter tension stretchable, elastic stitches in the bust area and torso midriff provide body smoothing and support as well as control to the bust area and wearer's midriff.

The outer bodice 106 is knitted or woven. The outer bodice 106 is either a non-stretchable fabric or a resiliently stretchable and contractible fabric, and is knitted or woven with spandex or elastane fibers, such as LYCRA® fibers. The fabric is suitably soft to the touch and flexible to drape about a wearer's body.

The outer bodice 106 has a continuous torso encircling portion 104*a* that completely encircles a torso midriff of the wearer. The torso encircling portion 104*a* is knitted, with spandex or elastane fibers knitted into vertical ribs on 104*a*, which can stretch resiliently and contract. A knitted vertical rib stitch on the front side of the fabric has its ribs alternating side-to-side with vertical ribs of a vertical rib stitch on the back side of the fabric. The ribs are thin or slender, fine ribs. The fabric stretches and contracts resiliently in two orthogonal directions to exert a force of resilient recovery from stretching.

Figure 2:
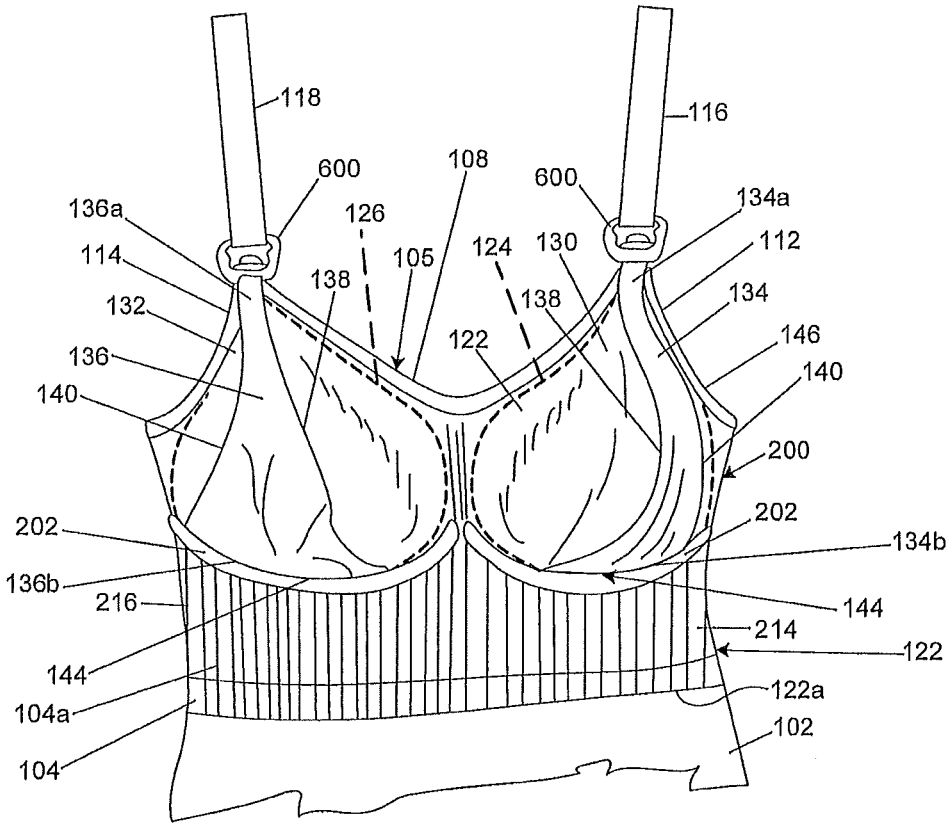
FIG. 2 is a fragmentary view of alternative embodiments of an inner panel or lining for lining the garment of FIG. 1.
Figure 2A:
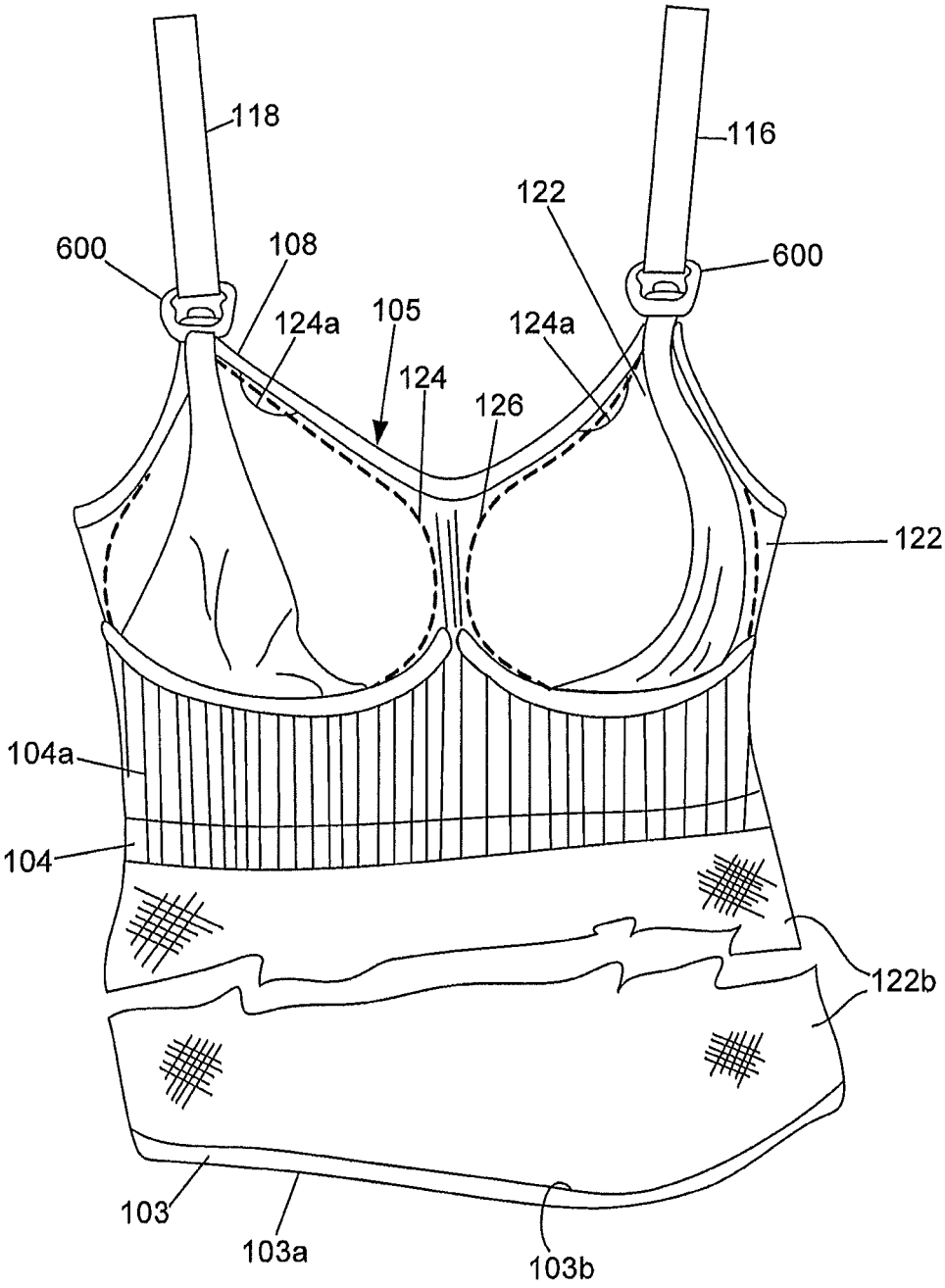
FIG. 2A and 2B show alternate views of another embodiment of the inner panel knitted or woven unitary with a tubular mesh lining.

A built-in bra 105 includes the outer bodice 106 preferably of knitted fabric and a lining provided by an inner panel 122, FIGS. 2 and 2A, preferably of knitted fabric. In a preferred embodiment, the inner panel 122 is continuous tubular within the tubular outer bodice 106. A bottom of the inner panel 122 is joined to the inside of the outer bodice 106 by knitting a junction of the outer bodice 106 and the bottom of the inner panel 122. Further, the built-in bra 105 has breast supporting, soft cups 124, 126 assembled in between the outer bodice 106 and the inner panel 122, and tacked in place with stitches. Alternatively, the soft cups are removable by passage through knitted openings 124*a*, FIG. 2A, in the inner panel 122 adjacent the front neckline 108 for laundering and replacement of the soft cups 124, 126. The knitted openings 124*a* are stretchable for enlargement and after stretching will shrink elastically.

Figure 1A:
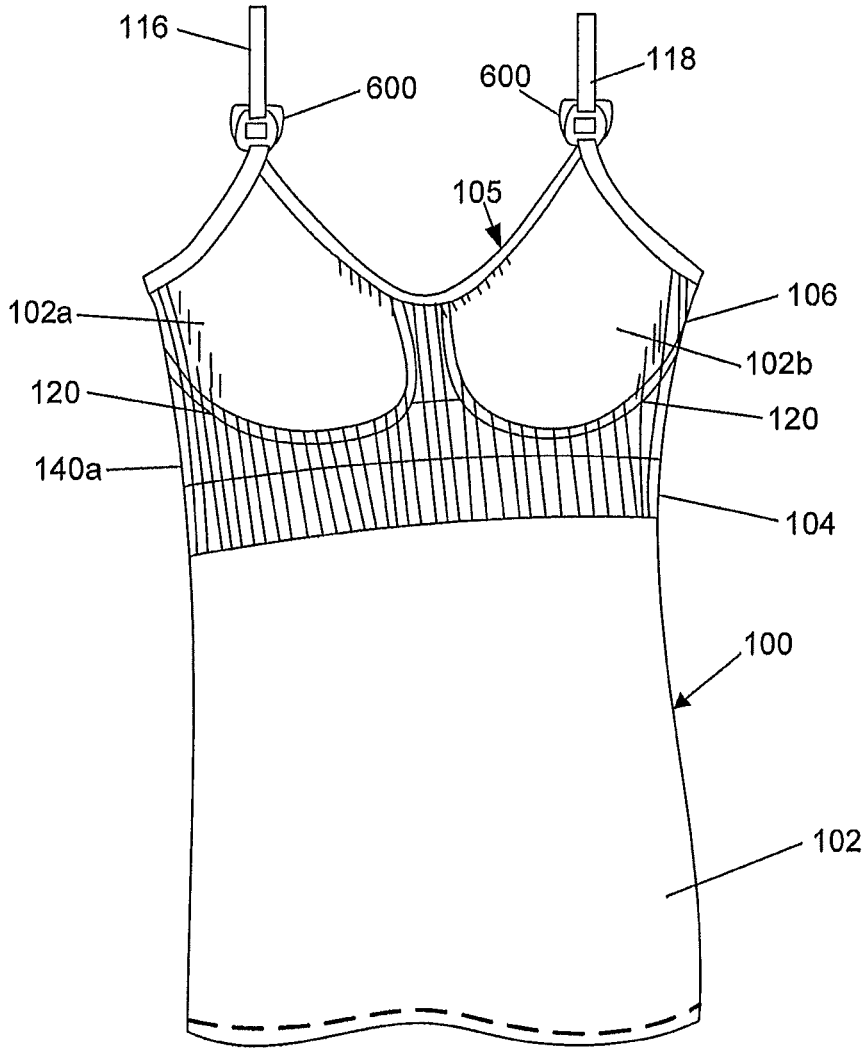
FIG. 1A is a front view of an alternative outerwear garment having a faux underwire built-in bra.

FIG. 1A discloses another embodiment wherein the outer bodice 106 or the inner panel 122 is knitted with dense stitches in the form of a faux underwire 120 to provide underwire support for the breasts of a wearer of the garment 100.

According to an embodiment, the outer bodice 106 has an unlined torso encircling portion 104*a* that extends below the inner panel 122. In another embodiment the unlined torso encircling portion 104*a* provides torso midriff support and smoothing. To provide torso midriff support and smoothing, the torso encircling portion 104*a* is knitted with extra spandex or elastane fibers, such as LYCRA® fibers in a rib stitch overlying a fine ribbed knit of the torso encircling portion 104*a*. A bottom of the inner panel 122 is joined to the inside of the outer bodice 106 by knitting a junction of the outer bodice 106 and the bottom of the inner panel 122.

Tension stretchable, elastic midriff support and smoothing is increased by increasing the gauge of the knit to a relatively high level. The gauge is a measurement: number of stitches per unit length. The tension stretchable, elastic midriff support and smoothing feature is suitable for the torso encircling portion 104*a* that is unlined by the inner panel 122.

In FIG. 2, embodiments of the inner panel 122 provide a lining of the built-in bra 105. The inner panel 122 extends from the front neckline 108 to the bottom of the soft cups 124, 126 including the faux underwire stitching 202. A bottom of the inner panel 122 is joined to the inside of the outer bodice 106 by knitting a junction of the outer bodice 106 and the bottom of the inner panel 122.

In FIG. 2 according to an unlined embodiment of the garment 100, the outer bodice 106 and the bottom portion 102 of the garment 100 are unlined below the built-in bra 105.

In FIG. 2, another embodiment of the inner panel 122 provides a lining covering the soft cups 124, 126 and further extends vertically from the front neckline 108 to the bottom of the chest band 104, and extends laterally or horizontally in continuous girth to provide a lining of the outer bodice 106, the chest band and the torso encircling portion 104*a*. A bottom of the inner panel 122 is joined to the inside of the outer bodice 106 by knitting a junction of the outer bodice 106 and the bottom of the inner panel 122.

Another preferred embodiment of the torso encircling portion 104*a* is lined by the inner panel 122 that provides a lining for the torso encircling portion 104*a*. The inner panel 122 provides a lining of the outer bodice 106, the chest band 104 and the torso encircling portion 104*a*. In FIG. 2, the inner panel 122 lining the torso encircling portion 104*a* is smoothly knitted with fine ribbed, torso midriff engaging sections 214, 216 below and adjacent to the soft cups 124, 126 and at sides along the underarm sections 112, 114. The torso midriff engaging sections 214, 216 stretch and contract resiliently in two orthogonal directions against a wearer's torso midriff, and engage the torso under the arms of the wearer and provide side-support for built-in bra support.

Further the inner panel 122 lining the torso encircling portion 104*a* provides midriff smoothing and support. Thereby, the inner panel 122 can be made with the extra spandex or elastane fibers, such as LYCRA® fibers in a rib stitch overlying a fine ribbed knit with an increased gauge to provide tension stretchable, elastic midriff support and smoothing. For this embodiment, the torso encircling portion 104*a* can be made without increasing the gauge of the knit so as to avoid tension stretchable, elastic midriff support and smoothing.

FIG. 2A discloses another embodiment of the inner panel 122 is knitted or woven unitary with, or is sewn to a separate fabric piece in the form of, an inner garment lower portion 122*b* providing a lining of the garment bottom portion 102. The inner garment lower portion 122*b* has its own perimeter bottom hem as shown in FIG. 2A that discloses how the inner garment lower portion 122*b* is hemmed by the bottom hem 103 described with reference to FIG. 1. And FIG. 2A discloses the inner garment lower portion 122*b* of the inner panel 122 that is knitted or woven in tubular form and sewn internally of the junction of the garment bottom portion 102 and the outer bodice 106 for lining the garment bottom portion 102. The mesh lining has a thin shear, elastic open mesh weave, similar to stretchable sheer hosiery, but stronger, to provide an abdomen control panel knitted with elastic fibers that engages, supports and smoothes an abdomen or tummy after giving birth. The garment bottom portion 102 covers the mesh lining and provides a covering outer garment that drapes freely from the mesh lining and its abdomen control panel to provide a smooth appearance free of lines from the inner garment lower portion 122*b*.

Figure 3A:
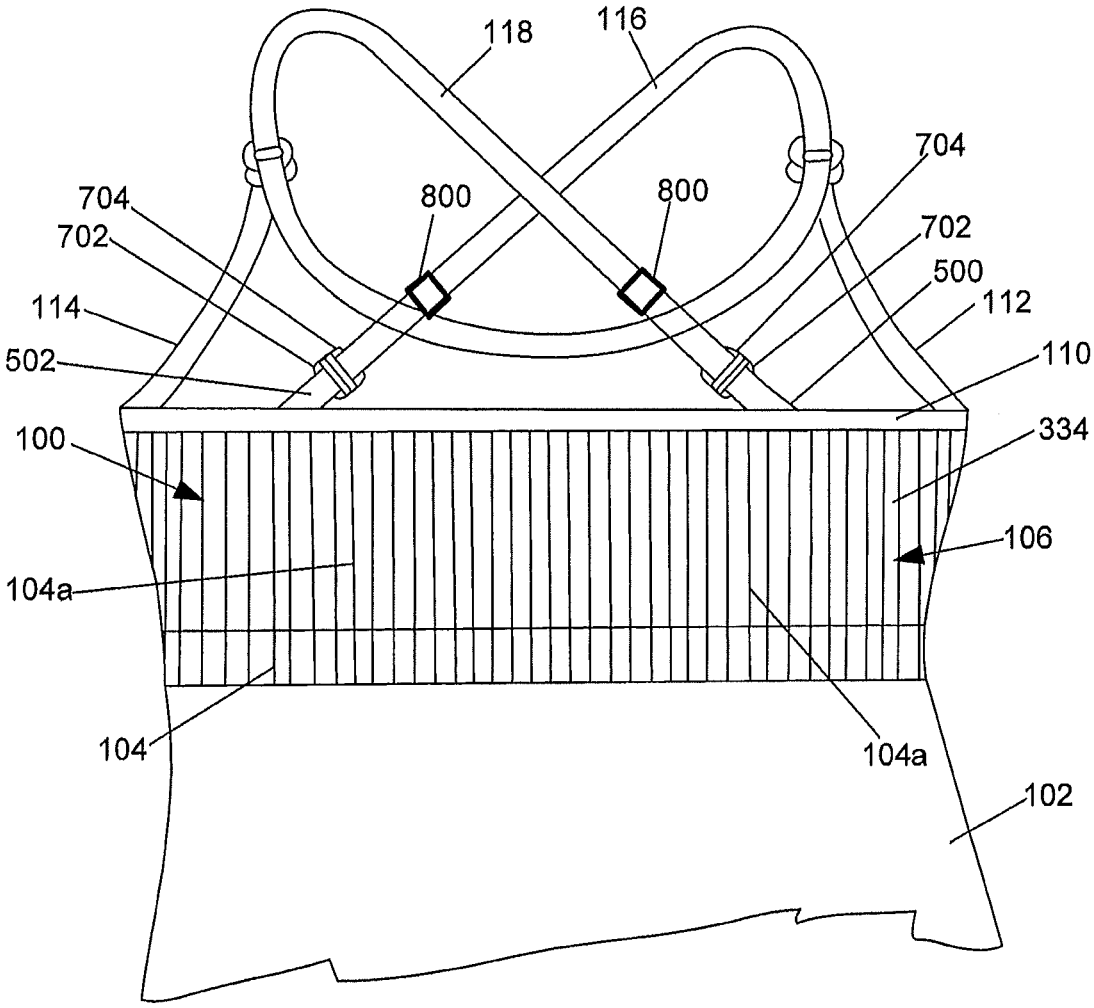
FIG. 3A is a view similar to FIG. 3 disclosing an alternative embodiment of the shoulder straps of FIG. 3.
Figure 3B:
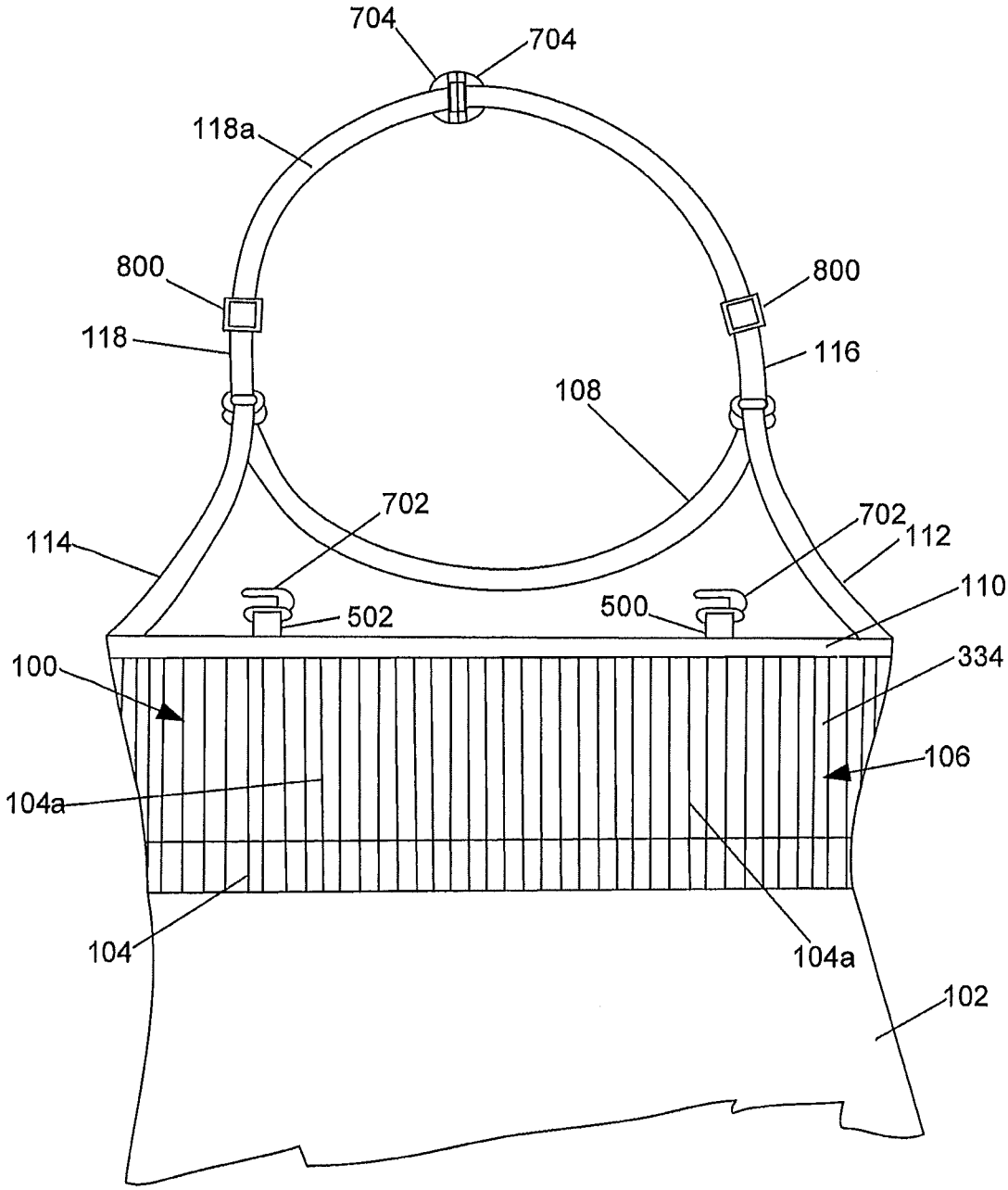
FIG. 3B is a view similar to FIG. 3 disclosing an alternative embodiment of the shoulder straps of FIG. 3.

Each of FIGS. 3, 3A and 3B discloses a back 334 of the outer bodice 106 of the garment 100. In each of FIGS. 3, 3A and 3B the torso encircling portion 104*a* extends continuously from the front of the garment 100, along the underarm sections 112, 114 and across the back side 334. The torso encircling portion 104*a* extends from the chest band 104 and the rib stitches constrict the back side 334 in a narrowed circumference to conform to the hollow anatomy, or small of the back, of the wearer of the nursing undergarment 100. The back side 334 of the torso encircling portion 104*a* can further include stitched ribs with increased tension stretchable, elastic support wherein the ribs further constrict the back side 334 in a narrowed circumference. The two direction orthogonal elastic stretch of the fabric of the back side 334 provides a wearer with bra support and circumferential back support of the wearer.

In FIGS. 1, 3 and 3A, the front neckline 108 and the back neckline 110 are attached to spaced apart shoulder straps 116, 118 for extending over respective shoulders of a wearer, to hold the garment 100 up and in place over the chest.

The shoulder straps 116, 118 are sufficiently long for ease in removal from the shoulders of a wearer without requiring connection and disconnection of the shoulder straps 116, 118. In FIG. 3, each of the bra shoulder straps 116, 118 is a flat, knitted stretchable material such as spandex and is fastened to the garment by light-weight flat or low profile fasteners 700, 800 of non-staining metal or plastic especially dimensioned and finished for use on lingerie and camisole garments and to lie flat and smoothly under clothing to minimize lines in the clothing.

Figure 4A:
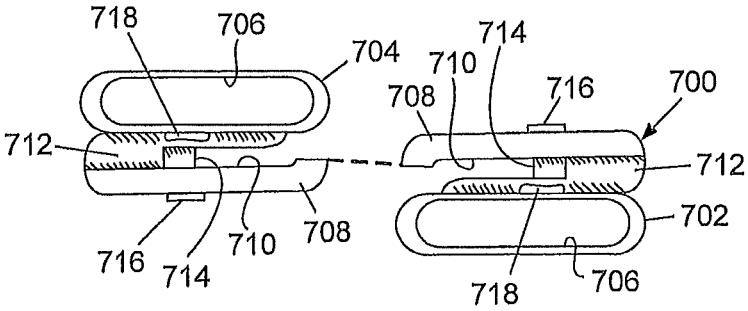
FIG. 4A is a front view of a first clasp and a second clasps to provide a detachable fastener.
Figure 4B:
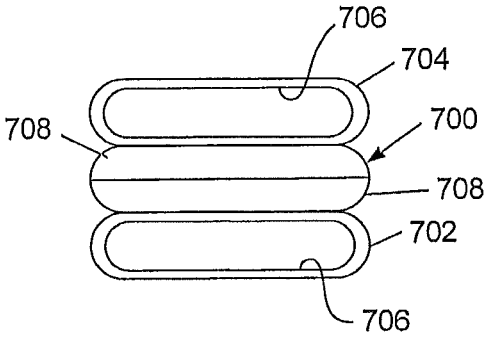
FIG. 4B is a front view of the clasps of FIG. 4A attached together.
Figure 4C:
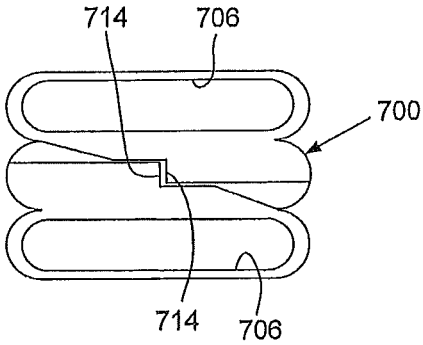
FIG. 4C is a rear view of the back of the clasps of FIG. 4B.

FIGS. 4A, 4B and 4C disclose a convertible fastener 700 to attach a corresponding bra shoulder strap 116, 118 to the garment 100. FIG. 4A discloses each of the fasteners 700 having a first clasp 702 and an identical second clasp 704, which are of hermaphroditic mating construction. The first clasp 702 and the second clasp 704 face in opposite directions with one of them being upside down for connection to each other. Each of the clasps 702, 704 is of unitary construction having an eye 706, a laterally extending latching arm 708 and a lateral passage 710 between the latching arm 708 and the eye 706. The lateral passage 710 extends along a back wall 712. The back wall 712 provides a tapered abutment 714 extending across the passage 710 part way. Each latching arm 708, 708 has a projecting tab 716, 716, and each back wall 712, 712 has a corresponding slot 718, 718 through the back wall 712, 712. Each of the passages 710, 710 of the clasps 702, 704 is open at one end to nest in mating connection with the mating clasp 702 or 704.

The clasps 702, 704 are nested in mating connection according to the following procedure, by way of example. A person uses both hands to grasp respective clasps 702, 704 between finger and thumb. The clasps 702,704 are oriented as disclosed by FIG. 4A, and are moved toward each other to nest with each other in mating connection. FIG. 4B discloses the clasps 702, 704 nested in mating connection with each other in their lateral passages 710, 710. While nested, the abutments 714, 714 of respective clasps 702, 704 register against each other to limit the depth of nesting of the clasps 702, 704, FIG. 4C. Further, while nested, the latch arms 708, 708 align with respective lateral passages 710, 710. Then, as shown in FIG. 4B, the clasps 702, 704 are pivoted to lie flat. For example, a person flattens the clasps 702, 704 by pinching between finger and thumb, which pivots the latch arms 708, 708 laterally until the latch arms 708, 708 resiliently snap fit into respective passages 710, 710. To lock the clasps 702, 704 in mating connection, each latching arm 708, 708 has a projecting tab 716, 716, and each back wall 712, 712 has a corresponding slot 718, 718. The latching arms 708, 708 are pivoted to register the projecting tabs 716, 716 with a resilient snap fit in a corresponding slot 718, 718. The procedure is reversed easily to disconnect the clasps 702, 704 from each other. To disconnect the clasps 702, 704 a person uses a thumb and one or more fingers of one hand to apply force to pivot the clasps 702, 704 to pivot the latching arms 708, 708 and unlock the projecting tabs 716, 716 from respective slots 718, 718. The clasps 702, 704 are then separated by moving them away from each other.

Figure 5A:
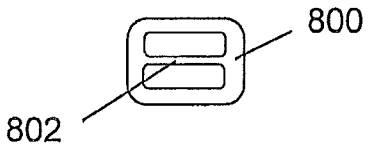
FIG. 5A is an elevation view of a front of a slide-buckle fastener.
Figure 5B:
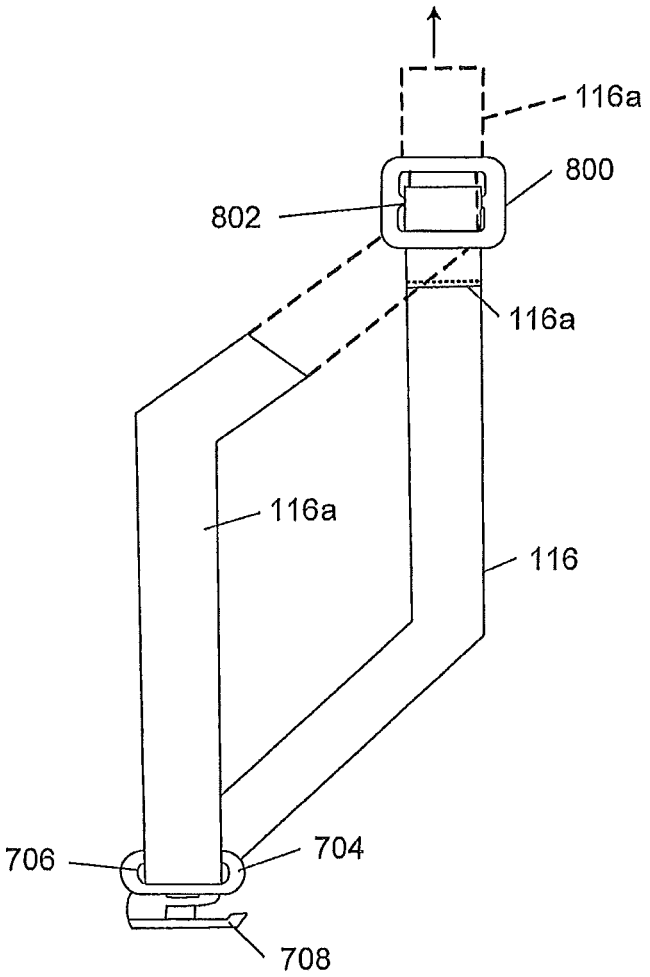
FIG. 5B is a schematic view of a shoulder strap assembled to the slide-buckle fastener of FIG. 5A and the second clasp of FIG. 4A.

FIGS. 5A and 5B disclose a corresponding bra shoulder strap 116 to be described with an understanding that the following description applies to either of two corresponding shoulder straps 116, 118. The corresponding shoulder strap 116, 118 is looped around a slender cross-rod 802 through the middle of the fastener 800 in the form of a slide-adjustable buckle 800. The end 116*a* is sewn in place. Then, the corresponding shoulder strap 116, 118 is threaded though a top eye 706 of a second clasp 704 of the fastener 700 disclosed by FIG. 4A, to provide a loop 116*b* returning to the buckle 800. The second clasp 704 is slidable along a length of a loop 116*b* of the corresponding shoulder strap 116, 118. The corresponding shoulder strap 116, 118 is threaded through both eyes of the slide-adjustable buckle 800, as disclosed by dotted lines 116*a* in FIG. 5B. The slide-adjustable buckle 800 is slidable along the lengths 116*a*, 116*b* of the respective shoulder strap 116, 118 to adjust the length of the loop 116*b*, and consequently to adjust the length of the shoulder strap 116, 118. In each of FIGS. 3, 3A and 3B, each of the shoulder straps 116, 118 has an adjustable function utilizing the slide-adjustable buckle 800, FIGS. 5A and 5B.

In FIGS. 3, 3A and 3B, the shoulder straps 116, 118 are convertible to different styles and functions utilizing the convertible fasteners 700. FIG. 3 discloses the shoulder straps 116, 118 in a tank top configuration, which is a style wherein respective shoulder straps 116, 118 are worn so as to extend essentially straight and to one side of the wearer's spine, and detachably connect to respective first clasps 702, 702 to provide straight back shoulder straps 116, 118. The first clasps 702, 702 are attached by respective fabric stem sections 500, 502 on the back 334 of the bodice 106 located offset to different sides of the wearer's spine. In each of FIGS. 3, 3A and 3B, at the back 334 of the garment 100, respective first clasps 702, 702 are attached by fabric stem sections 500, 502 for connecting the shoulder straps 116, 118. The stem sections 500, 502 can have the same fabric construction as the shoulder straps 116, 118. The stem sections 500, 502 thread through the eyes 706, 706 of the first clasps 702, 702 and are sewn to the back 334 to connect the first clasps 702, 702 on the back 334. The fabric stem sections 500, 502 are adapted for being tucked inside the back 334 behind the neckline 110.

According to an embodiment, the first clasps 702, 702 on the back 334 face in a same, first direction, and the second clasps 704, 704 on the straps 116, 118 face in a second, same direction opposite the first direction to connect to either of the first clasps 702, 702. According to an alternative embodiment, one or both of the straps 116, 118 twist to orient the second clasps 704, 704 in directions to connect to the first clasps 702, 702 that face in first directions, respectively, which avoids a need for the first clasps 702, 702 to face in predetermined first directions. FIG. 3A discloses an alternative embodiment to provide a racer back configuration, which is a style wherein the shoulder straps 116, 118 cross over each other and cross over the wearer's spine to provide racer back straps 116, 118. The second clasps 704, 704 on the crossed-over shoulder straps 116, 118 detachably connect to respective first clasps 702, 702.

FIG. 3B discloses an alternative embodiment to provide a halter back configuration, wherein the shoulder straps 116, 118 detachably connect to each other end on end to extend in a loop 118*a* behind a neck of a wearer of the garment 100 to hold the garment up. The second clasps 704, 704 detachably connect to each other to extend the shoulder straps 116, 118 in the loop 118*a* behind a wearer's neck to provide a halter strap to hold the garment up. The second clasps 704, 704 on the shoulder straps 116, 118 are of hermaphroditic mating construction to connect to each other in mating connection. According to an embodiment, the first clasps 702, 702 on the back 334 face in a same, first direction, and the second clasps 704, 704 on the straps 116, 118 face in a second, same direction opposite the first direction to connect to either of the first clasps 702, 702. Alternatively, the shoulder straps form a loop 118*a*, FIG. 3B, to extend behind a wearer's neck. Advantageously, the loop 118*a* orients the second clasps 704, 704 to face opposite directions to connect to each other and provide a halter strap. According to an alternative embodiment, the second clasps 704, 704 are oriented in directions to connect to each other by twisting one or both of the straps 116, 118, which avoids a need for the second clasps 704, 704 to face in predetermined directions. In FIG. 3B, the fabric stem sections 500, 502 can be tucked inside the back 334 behind the neckline 110.

The shoulder straps 116, 118 are convertible straps 116, 118 for the wearer to wear the garment 100 under many different outer clothing options because the straps 116, 118 are able to convert to tank straps or racer-back straps or halter straps. The back adjustable shoulder straps 116, 118 having the using the clips 700 allow the wearer to be able to use the garment 100 under many different types of outer layer clothing by being able to convert the straps 116, 118 to tank straps, racer-back straps or a halter strap function.

Figure 6:
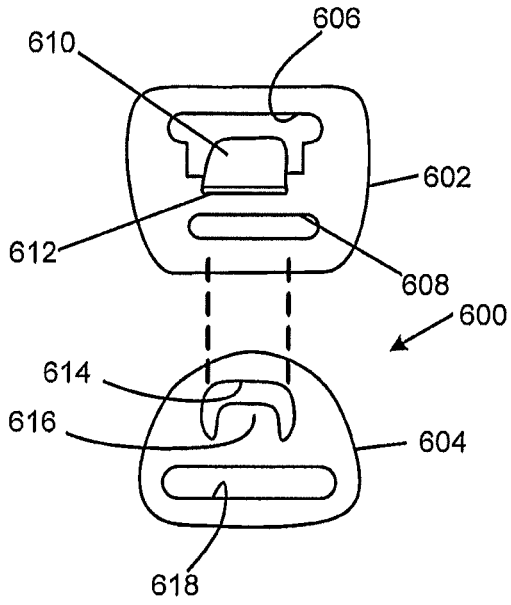
FIG. 6 discloses a nursing clip having two interlocking portions.

In FIG. 2, front ends of the shoulder straps 116, 118 are assembled with nursing clips 600, FIG. 6. The front ends of the shoulder straps 116, 118 form loops extending through top eyes 606, FIG. 6, and the loops are cross stitched to captivate the nursing clips 600.

In FIG. 1, the outer bodice 106 has a center front stitch 128 in the form of a knitted, center front elastic band, which is stretchable and contractible, and which forms a fashion front for a fashionable appearance. In FIG. 1, the elastic band 128 is knitted with spandex or elastane fibers. The center front elastic band 128 is knitted with a vertical rib stitch on a front side of the fabric, and is knitted with a horizontal rib stitch on a back side of the fabric, such that the knitted ribs on front and back sides, respectively, are orthogonal to one another and provide a stiffly stretchable and resilient bra-like support. The knitted, center front stitch 128 is relatively narrow and extends vertically between the smooth cup portions 102*a*, 102*b* and vertically between the breast cups 124, 126 such that the center front stitch 128 extends vertically between the breasts of a wearer. An embodiment of the stitch 128 widens at the bottom thereof to provide widened support below the level of the wearer's breasts. Further, the center front stitch 128 restricts undesired lateral shifting of the outer bodice 106 when worn. The center front elastic band 128 extends lengthwise vertically from near the front neckline 108 to near the chest band 104 and attaches with stitches the outer bodice 106 to the stretchable inner panel 122, which partitions the stretchable inner panel 122 into cup receiving pockets 130, 132, FIG. 2, that retain the breast soft cups 124, 126, and prevent the cups 124, 126 from shifting positions, especially while the garment is worn or being laundered.

An embodiment of a center front stitch 128 is formed by gathering the fabric of the elastic outer bodice 106 along a vertical, center front line and forming horizontal, random pleats, then sewing the gathered fabric along the center front line. Another embodiment of a center front stitch 128 in is provided by an elastic band sewn to a non-pleated, smooth elastic outer bodice 106 covering bra soft cups 124, 126.

FIG. 2 discloses a stretchable inner panel 122 forming a lining in the outer bodice 106. Further, FIG. 2 discloses a pair of soft padded breast cups 124, 126 between the outer bodice 106 and the inner panel 122 or lining. The cups 124, 126 are soft to the touch and are deformable against a wearer's anatomy to provide comfort while worn. The cups 124, 126 are retained in corresponding pockets 130, 132 without fasteners, which provides a smooth and modest appearance by conforming the fabric of the garment 100 to the smooth exterior contour of in the absence of fasteners that would disrupt the contour. The left and right front internal areas are attached to the front of the garment with fashioning stitches so the two layers of fabric are constructed as one.

The soft cups 124, 126 are sandwiched between an outer fabric layer of the outer bodice 106 and an inner panel 122 of a fabric layer and are held in place with fashioning stitches so the cups do not move when wearing or washing. The smooth cup portions 102*a*, 102*b* of the outer bodice 106, the stretchable inner layer 122, the soft cups 124, 126, the center front stitch 128 and stretchable elastic chest band 104 each contribute to a bra-like support of the wearer's breasts.

The soft cups 124, 126, the adjacent smooth cup portions 102*a*, 102*b* of the outer bodice 106 and the adjacent stretchable inner layer 122 provide a built-in inner bra to support the wearer's breasts. The cups provide support and modesty to the wearer. The breast area is held in place with fashioned stitch support, without a shelf bra construction.

In FIG. 2, the top edges of the built-in bra 105 adjacent to the top edges of the soft cups essentially coincide with the front neckline of the garment. The top edge of the garment 100, along the front neckline 108, along arm receiving openings of underarm sections 112, 114 and along the back neckline 110, is finished or trimmed with a facing reinforcement or edge binding 146. The edge binding 146 is threaded through detachable portions 604, 604 of a pair of nursing clips 600, 600, FIG. 6.

FIG. 6 discloses a fastener 600 in the form of a nursing clip 600, a light-weight flat fastener 600 of non-staining metal or plastic especially dimensioned and finished for use on lingerie and camisole garments and to lie flat under clothing. The nursing clip 600 has a first portion 602 and an interlocking, detachable portion 604 shown detached in FIG. 6. A top eye 606 through the first portion 602 provides an eye fastener 602. A bottom eye 608 through the first portion 602 provides another eye fastener 608. Adjacent to the top eye 606 is a unitary hook 610 having underneath a latching surface 612.

The detachable portion 604 detachably clips onto the first portion 602 of the nursing clip 600 by having a segment of a ring 614 to register onto the hook 610. The ring 614 is at a top end of the detachable portion 604. A resilient latching tab 616 projects upward toward the ring 614 and registers against the latching surface 612 on the hook 610 to clip the ring 614 on the hook 610. To detach the ring 614 from the hook 610, a person applies a force to remove the ring 614 from the hook 610, to overcome the registration of the resilient latching finger 616 against the hook 610. An eye 618 through a bottom end of the detachable portion 604 provides an eye fastener 618.

The edge binding 146 is threaded through the eyes 618, 618, respectively of the detachable portions 604 of the pair of nursing clips 600, 600. The edge binding 146 positions the nursing clip detachable portions 604 at locations on the front neckline 108 wherein the shoulder straps 116, 118 are to connect. The edge binding 146 closes the top edges of the two layers of fabric by stitching performed on a standard sewing machine, not shown.

The facing reinforcement or binding 146 can be of continuous single piece construction. Alternatively, the facing reinforcement or edge binding 146 can be individual pieces sewn end-on-end. The edge binding 146 is made of stretch material For example, the facing reinforcement or binding 146 can be seamless to extend continuously along the front neckline 108, and through each eye 618 wherein the shoulder straps are to connect to the front neckline 108. Further the seamless facing reinforcement or binding 146 extends continuously along each of the underarm sections 112, 114 at the ends of the front neckline 108. The facing reinforcement or edge binding 146 extends through each of the nursing clip detachable portions 604 and is cross-stitched adjacent to the eye 618 to hold each of the nursing clip detachable portions 604 in place. The edge binding 146 is attached to the detachable portions 604 of the nursing clips 600, which connects the built-in bra 105 to the detachable portion of the nursing clip 600. Further, a detachable portion 604 of a nursing clip 600 is attached to a first portion 602 of the nursing clip 600 on a corresponding shoulder strap 116, 118. The built-in bra 105 is prepared for nursing by disconnecting one of the detachable portions 604 from a corresponding nursing clip 600, which disconnects one side of the built-in bra 105 from a corresponding shoulder strap 116, 118, followed by pulling down one side of the built-in bra 105 to expose a breast for nursing. After completion of nursing, the built-in bra 105 is pulled up and the detachable portion 604 is attached to a corresponding nursing clip 600.

The invention fulfills a need for a nursing garment 100 that is functional in terms of securing the bust area and having a nursing function without openings through the outer bodice 106 or through the built-in bra 105, while providing an outer bodice 106 and built-in bra 105 for modesty and breast support and an attractive appearance. Further, the invention provides a nursing garment 100 having soft breast cups 124, 126 as part of the built-in bra 105.

The breast cups 124, 126 cover the wearer's breasts to cover the anatomy and provide a non-revealing smooth profile covered by the outer bodice 106. In addition to providing a smooth and modest appearance, the breast cups 124, 126 are advantageously constructed of moisture absorbing material, and/or soft padding material. Further, each of the breast cups 124, 126 has a shaped interior contour to provide support for the breast, and to cover the breast for absorbency and modesty. Each of the breast cups 124, 126 has a shaped exterior contour providing a smooth and attractive outer appearance when covered by the inner bodice 108 and outer bodice 102.

A structural composition of the soft cups 124, 126 includes, but is not limited to natural fibers, feathers, down, polymeric fibers, polymeric foam or a combination thereof. Further the soft cups 124, 126 can be absorbent of fluid matter and washable in detergent. Alternatively, an anti-bacterial composition can be provided as an additive incorporated in or permeating the structural composition, or can be provided as an additive that is applied by being sprayed or coated on the structural composition.

In FIG. 2, an embodiment of the inner panel 122 is constructed of a smooth stretchable fabric, knitted or woven, covering the soft cups 124, 126. The stretchable fabric includes spandex or elastane fibers, such as LYCRA® fibers. The breast cups 124, 126 are drawn against the wearer's breasts by the elastic resiliency of the stretchable inner panel 122 to augment the bra-like support provided by the outer bodice 106 and the chest band 104.

The soft cups 124, 126 are tacked in place to the inner panel 122 and the outer bodice 106 so as to be immoveable during washing or wearing. An embodiment of the inner panel 122 is sewn to the edge circumference of each of the breast cups 124, 126 that retain the cups 124, 126 and prevent the cups from shifting positions, especially while the garment is worn or being laundered. Such a structure enables an embodiment of the outer bodice 106 to be made with or without a center front stitch 128. The fashioning stitches under the bust area create a support band under the bust as well as serve as a connecting seam between the outer and inner layers.

In FIG. 2, the fashioning stitches are knit with a high degree of tension and stitch density to form a faux underwire support 120 for the breasts, which faux underwire support 120 is provided by sewn heavy stitching 202 of the inner panel 122 to be positioned under each of the soft cups 124, 126 that are tacked or sewn between the inner panel 122 and the outer bodice 106.

Each of FIGS. 2 and 2A discloses the shoulder straps 116, 18 include sling supports 134, 136. A sling support 134 on a right hand side of the garment 100, and a sling support 136 on the left hand side, are sewn in place and hidden behind the inner panel 122 and behind a corresponding soft cup 124, 126 covered by the inner panel 122. Thereby the sling supports 134, 136 are separate from the built-in bra 105. Further, the sling supports 134, 136 are separate from the underarm section 112, 114 of the outer bodice 106. The underarm sections 112, 114 of the outer bodice 106 cover the sling supports 134, 136 to be hidden from view. Each of FIGS. 2 and 2A discloses the left side, sling support 136 in a form as manufactured, and discloses the right side, sling support 134 in a form while supporting and conforming to a breast. Further, in FIG. 2B, the sling support 136 supports a lateral side of a breasts and partially covers the breast during nursing and in preparation of the garment 100 for nursing. Similarly, the sling support 136 supports a lateral side of a breasts and partially covers the breast during nursing and in preparation of the garment 100 for nursing.

Top ends of the sling supports 134, 136 are attached to respective nursing clip portions 602, FIG. 6. The top ends of the sling supports 134, 136 are threaded through respective bottom eyes 608, FIG. 6, and are looped and cross stitched to captivate the nursing clip portions 602.

While the garment 100 is worn with the shoulder straps 116, 118 adjusted in length, each soft cup 124, 126 is contoured to cover and support a main first portion of a breast surface area covered by a corresponding cup 124, 126, and each sling support 134, 136 supports and conforms to the shape of a second portion comprised of an under portion of a breast surface area and a side of a breast surface area that is uncovered by a corresponding cup 124, 126. Each of FIGS. 2 and 2A discloses the right side, sling support 134 in a form while supporting and conforming to a breast.

Figure 2B:
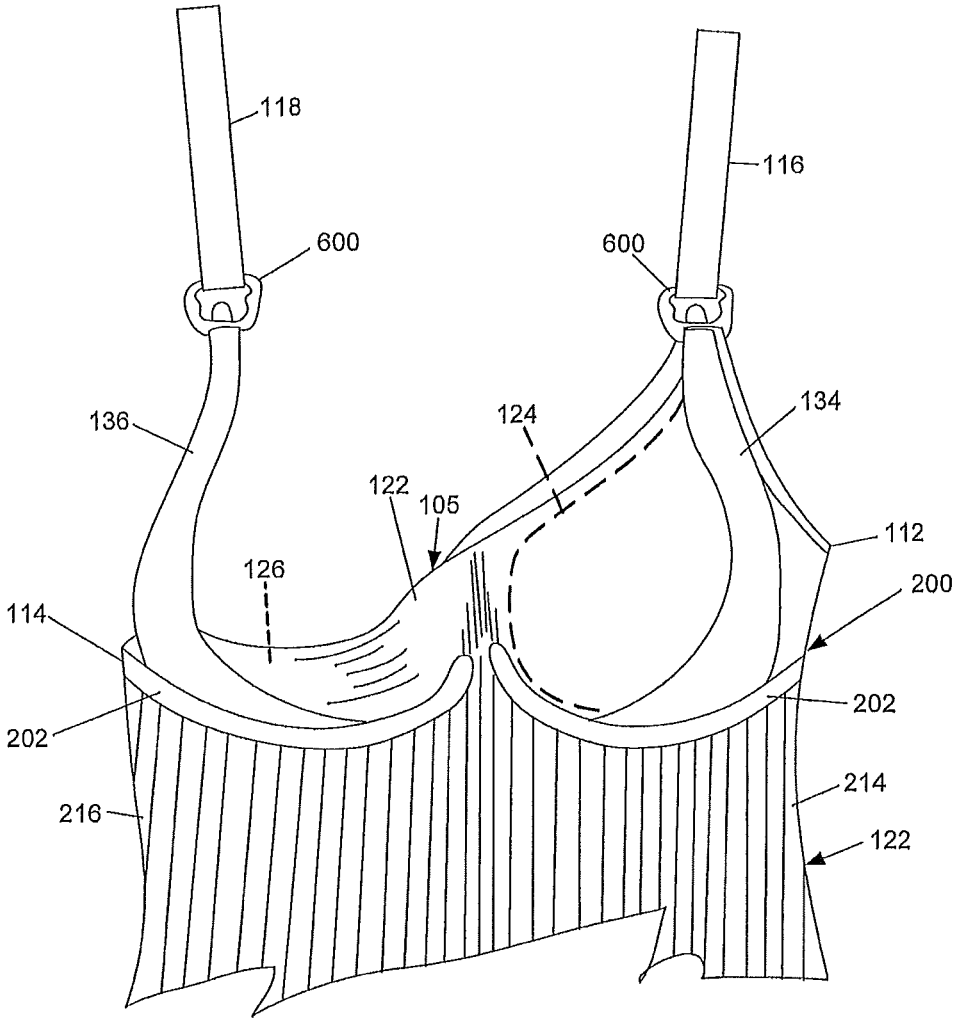

FIG. 2B discloses the left side, sling support 136 in a form while supporting and conforming to a side of a breast and a portion of the bottom of the breast, while exposing another portion of the breast for nursing. In preparation for nursing and during nursing, the left side of the built-in bra 105 is detached by detaching the nursing clip portion 604 from the nursing clip portion 602, followed by pulling down the left side of the built-in bra 105 to expose a left breast for nursing. The right side, sling support 134 supports and conforms to a breast while the while the left side of the built-in bra 105 is pulled down in preparation for nursing and during nursing. At all times, the sling supports 134, 136 remain attached to the shoulder straps 116, 118 to hold the garment 100 up while supporting the breasts. In an embodiment of the invention, the shoulder straps 116, 118 are considered to include the sling supports 134, 136 to hold the garment 100 up.

The outer bodice 106 the inner panel 122 and the soft cups 124, 126 are without openings therethrough to expose a breast for nursing. Instead, the nursing clips 600 allow the left and right sides of the garment 100 to open independently for access to each breast in preparation for nursing. In preparation for nursing an infant, the outer bodice 106 and the built-in bra 105 are detached from one of the shoulder straps 116, 118, and are pulled down to uncover a portion of a breast. After nursing is completed, the outer bodice 106 and the built-in bra 105 are re-attached to the shoulder strap.

Each sling support 134, 136 has an inner edge 138 facing toward a sternum when worn, and an outer edge 140 facing toward a corresponding arm receiving opening 112, 114 of the garment 100. The outer edges 140 are separate from the bra soft cups 124, 126, and are lateral and rearward of the soft cups 124, 126 to engage and support lateral portions of the breasts that project laterally and rearward of the soft cups 124, 126. Between the inner edge 138 and the outer edge 140 each sling support 134, 136 widens progressively from its upper end 134*a*, 136*a* to its bottom end 134*b*, 136*b* to provide a triangular shaped sling support to support along a portion of a breast, while exposing another portion of the breast for nursing. The widened section is contoured and shaped to conform against a breast to keep the breast secure. A curved bottom edge 142 on each sling support 134, 136 is attached by sewing to the inner layer 122 and the outer bodice 106 of the garment 100 adjacent to a curved bottom of a soft cup 124, 126. Thereby, the sling supports 134, 136 are attached to a front of the garment 100. The bottom edge 142 of each sling support 134, 136 extends laterally beyond a lowest point 144 on the curved bottom of a corresponding soft cup 124, 126. The bottom edge 142 is curved to follow along the curved bottom of the corresponding soft cup 124, 126 to provide sling support over part of the bottom of a breast and laterally over a lateral portion of the breast, and especially provides such support while a corresponding soft cup 124, 126 is pulled down from the breast during nursing and in preparation of the garment 100 for nursing.

The shoulder straps 116, 118 include the sling supports 134, 136 to keep the garment 110 up and in place over the torso. Upper ends 134*a*, 136*a* of the sling supports 134, 136 attach the shoulder straps 116, 118. Each sling support 134, 136 is attached at its bottom end 134*b*, 136*b* and is joined to the garment along the curved bottom of a bra cup. This combination of structural elements holds the garment up while being worn especially during nursing and in preparation for nursing.

In FIG. 2, an embodiment of the outer bodice 106 is knitted in seamless tubular form, with the top necklines 108, 110 and the arm receiving openings 112, 114 knitted as edges along openings in the tubular form. Similarly, the inner panel 122 or lining is knitted in seamless tubular form, with the top necklines 108, 110 and the arm receiving openings of the underarm sections 112, 114 knitted as edges along openings in the tubular form. A method of making a knitted garment 100 includes, a process of continuous circular knitting to form a seamless tubular knitted bottom portion 102 of the garment 100, united in series with a unitary seamless tubular knitted chest band 104, united in series with a unitary seamless tubular knitted outer bodice 106, and a bottom of a unitary seamless tubular knitted inner panel 122, encircled by the seamless tubular outer bodice 106, and knitting the necklines 108, 110 and underarm sections 112, 114 on both the tubular outer bodice 106 and the tubular inner panel 122. A programmable circular knitting machine is programmed to perform the continuous circular knitting process in conjunction with appropriate changes in different types of stitches and with appropriate combining of different fibers to be knitted into different sections of the knitted garment 100.

A method according to the invention is performed, by using a knitting machine to create a seamless knitted outer bodice 106, bottom portion 102 and inner panel 122, then attaching the fasteners 600, 700 and 800 and sling supports 134, 136 and shoulder straps 116, 118 using a conventional sewing machine. A jersey or rib stitch with tighter tension stretchable, elastic stitches in the mid section of the garment provides shape and support to the mid-section of the wearer Because it is a seamless knit, there are no uncomfortable side seams to rub against the skin nor are there back hooks for closure that are uncomfortable on the back. The seamless knit is very stretchy, which makes it smooth and comfortable to fit conformably to a variety of body types and sizes.

A method of making a nursing garment 100 includes the steps, as follows: simultaneously knitting the outer bodice 106 and the inner panel 122, wherein the inner panel 122 is formed by knitting thereof inside the knitted outer bodice 106. An embodiment of the method includes knitting the chest band 104 simultaneously with knitting the outer bodice 106. An embodiment of the method includes knitting the outer bodice 106 with the tension stretchable, elastic stitches. According to an embodiment of the method, the knitting steps can end or terminate so as to manufacture a bodice 106 of a nursing bra, wherein the nursing bra is manufactured as a nursing bra type nursing garment 100 without having, both a garment bottom portion 102 and its lining 102*b*. The method further includes the steps as follows: assembling the soft cups 124, 126 between the outer bodice 106 and the inner panel 122 to provide a built-in bra 105; assembling an edge binding 146 with detachable portions 604, 604 of nursing clips 600, 600 and sewing the edge binding 146 to join tops of the outer bodice 106 and the inner panel 122 to connect the built-in bra 105 to the detachable portions 604, 604 of the nursing clips 600, 600; sewing sling supports 134, 136 and shoulder straps 116, 118 to the garment 100; and attaching the sling supports 134, 136 and shoulder straps 116, 118 to portions 602, 602 of the nursing clips 600, 600 to hold the garment up while the detachable portions 604, 604 of the nursing clips 600, 600 are detachable from the portions 602, 602 to pull down the built-in bra 105 in preparation for nursing.

An alternative method of making a nursing garment 100 includes the steps, as follows: knitting a seamless tubular bottom portion 102; knitting a junction of the seamless bottom portion 102 with a tubular outer bodice 106 and a tubular inner panel 122; and simultaneously knitting the outer bodice 106 and the inner panel 122, wherein the inner panel 122 is formed by knitting thereof inside the knitted outer bodice 106. An embodiment of the alternative method includes knitting the chest band 104 simultaneously with knitting the outer bodice 106. An embodiment of the alternative method includes knitting the outer bodice 106 with the tension stretchable, elastic stitches. The method further includes the steps as follows: assembling the soft cups 124, 126 between the outer bodice 106 and the inner panel 122 to provide a built-in bra 105; assembling an edge binding 146 with detachable portions 604, 604 of nursing clips 600, 600 and sewing the edge binding 146 to join tops of the outer bodice 106 and the inner panel 122 to connect the built-in bra 105 to the detachable portions 604, 604 of the nursing clips 600, 600; sewing sling supports 134, 136 and shoulder straps 116, 118 to the garment 100; and attaching the sling supports 134, 136 and shoulder straps 116, 118 to portions 602, 602 of the nursing clips 600, 600 to hold the garment up while the detachable portions 604, 604 of the nursing clips 600, 600 are detachable from the portions 602, 602 to pull down the built-in bra 105 in preparation for nursing.

The method further includes the knitting steps as follows: According to another embodiment of the method, the knitting steps manufacture the knitted outer bodice 106 continuously knitted with a knitted garment bottom portion 112 to provide a nursing garment 100, for example, having the form of a nursing cami. The garment bottom portion 112 is either unlined or is lined by knitting steps to manufacture the knitted outer bodice 106 with both, a knitted garment bottom portion 112*a* knitted lining 112*b*. The bottom hems 103 are either turned back at a folded edge 103*a* and an anchoring stitch 103*b* is sewn along the edge of the fabric, or alternatively, the bottom hems 103 are continuously knitted with a turned back folded edge 103*a* and knitted with the anchoring stitch 103*b*.

The method further includes the steps as follows: assembling the soft cups 124, 126 between the outer bodice 106 and the inner panel 122 to provide a built-in bra 105; assembling an edge binding 146 with detachable portions 604, 604 of nursing clips 600, 600 and sewing the edge binding 146 to join tops of the outer bodice 106 and the inner panel 122 to connect the built-in bra 105 to the detachable portions 604, 604 of the nursing clips 600, 600; sewing sling supports 134, 136 and shoulder straps 116, 118 to the garment 100; and attaching the sling supports 134, 136 and shoulder straps 116, 118 to portions 602, 602 of the nursing clips 600, 600 to hold the garment up while each of the detachable portions 604, 604 of the nursing clips 600, 600 is detachable from one of the portions 602, 602 to disconnect and pull down one side of the built-in bra 105 in preparation for nursing.

The sling supports 134, 136 and internal built-in bra 105 are connected internally to the external camisole garment 100 to form an integral part of the garment top. There is no uncomfortable elastic under the breasts holding the garment 100 in place. Knitted or woven sling supports 134, 136 are behind the soft cups 124, 126 and are stitched to the built-in bra 105 under a bust line, and to the shoulder straps 116, 118 by way of the nursing clips 600. This construction prevents the straps 116, 118 from coming off the shoulders when the garment is unclipped for nursing. The sling supports 134, 136 and built-in bra 105 are hidden from view and are connected internally to the external portion of the garment 100 and are an integral part of the camisole construction.

The seamless knit, soft cups 124, 126 at bust, and hidden nursing sling supports 134, 136 make the garment 100 look smooth on the outside with the only nursing detail apparent to the eye being the nursing clips 600. The fashioning stitches at the sides and bust area create shape and support for the breasts when wearing the garment 100. The garment includes a higher tension stretching elasticity of the knit due to an increased gauge, or stitch density of the yarns containing spandex yarns in the torso midriff of the garment 100 to give the wearer a body smoothing function that helps hold the mid-section in place and also offers the wearer modesty under her outerwear top. The gauge, or stitch density, of the yarns containing spandex is increased to provide a stiffly stretchable, elastic foundation garment area supporting, smoothing and shaping a post-partum torso midriff. The bodice 106 is constructed with a smooth fabric inner layer 122 and a fabric outer layer of the outer garment. The smooth fabric inner layer 122 of the bodice 106 provides a smooth and comfortable inner layer of stretchable jersey knit. The fabric outer layer of the garment 100 is a single layer, seamless jersey knit unifying the bodice 106 unitary with an outer garment bottom portion 102 to provide a camisole top, sleepwear or other article of outerwear clothing. The fabric outer layer is knitted below the built-in bra 105 with tension stretchable, elastic stitches across the front of the garment for mid-section torso support to support, smooth and shape a post partum torso. The elastic stretchable stitches extend across the front of the front of the garment, and under the arm receiving openings and across the back of the bodice to provide a built-in stretchable, back strap of the built-in bra 105. Further, the tension stretchable, elastic stitches extend below the back strap and surrounds the wearer to provide midriff support below the built-in bra 105 and its back strap.

Further, the front, back and lateral sides of the bodice is lined with the smooth fabric inner layer that is made advantageously by seamless and continuous knitting. The tension stretchable, elastic stitches press against a torso to provide smoothing, but are not relied upon to hold the garment up. Instead, it is the permanent connection of the shoulder straps to the sling supports that hold the garment up at all times when worn, even during nursing and during preparation for nursing.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawling support under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Patents and patent applications referred to herein are hereby incorporated by reference in their entireties. Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A nursing garment comprising:

a built-in bra having an outer bodice and an inner panel;

shoulder straps having first ends connected to a back of the outer bodice, wherein the shoulder straps have second ends connected to a front of the outer bodice; and the built-in bra is without openings therethrough for nursing, and top ends of the built-in bra are connected by detachable fasteners to respective shoulder straps wherein each of the top ends of the built-in bra is detachable from one of the respective shoulder straps in preparation for nursing.

2. The nursing garment of claim 1 wherein the detachable fasteners detachably connect a neckline on the outer bodice to the shoulder straps, and the neckline is detachable from one of the shoulder straps in preparation for nursing.

3. The nursing garment of claim 1 further comprising soft cups between the outer bodice and the inner panel of the built-in bra.

4. The nursing garment of claim 1, comprising:

tension stretchable stitches in the outer bodice below the built-in bra provide a foundation garment area for torso midriff support.

5. The nursing garment of claim 1, comprising:
a chest band; and the chest band and the outer bodice are knitted together.

6. The nursing garment of claim 1, comprising:
a knitted bottom portion of the garment is joined at a knitted junction with the outer bodice knitted in tubular form.

7. The nursing garment of claim 6, wherein the knitted junction comprises a chest band.

8. The nursing garment of claim 6, comprising:
the garment bottom portion having a knitted bottom hem with a turned back edge and knitted with an anchoring stitch along the edge.

9. The nursing garment of claim 6, comprising;
tension stretchable, elastic stitches in the outer bodice provide a foundation garment area for torso midriff support.

10. The nursing garment of claim 3, comprising:
openings in the inner panel for passage of the soft bra cups.

11. The nursing garment of claim 1, comprising:
adjustable fasteners on the shoulder straps to adjust the lengths of the shoulder straps.

12. The nursing garment of claim 1, comprising:
stitches in the outer bodice providing a faux underwire support.

13. The nursing garment of claim 1, comprising:
a garment bottom portion; and
a junction of the garment bottom portion with the outer bodice;
a stretchable lining in the garment bottom portion.

14. The nursing garment of claim 1, comprising;
a garment bottom portion;
a junction of the garment bottom portion with the outer bodice; and
a stretchable lining in the garment bottom portion is joined to the junction.

15. The nursing garment of claim 1, comprising:
a tubular bottom portion; and
a junction of the tubular bottom portion with the outer bodice and the inner panel, wherein the tubular bottom portion is knitted and seamless, the outer bodice is knitted and seamless and the inner panel is knitted and seamless.

16. The nursing garment of claim 15, comprising:
a lining in the tubular bottom portion.

17. The nursing garment of claim 1, comprising:
first clasps attached to the back of the outer bodice and second clasps attached to the shoulder straps, wherein the second clasps attach to respective first clasps to provide straight back shoulder straps, and alternatively wherein the second clasps cross over each other and attach to respective first clasps to provide racer back straps, and alternatively wherein the second clasps attach to each other to provide a halter back strap.

18. The nursing garment of claim 17, comprising:
the shoulder straps form loops, respectively;
the second clasps are slidable along the loops;
ends of the loops connect to center rails of slide-adjustable buckles; and
the shoulder straps extend through eyes of the slide-adjustable buckle to form the loops.

19. The nursing garment of claim 17, wherein the first clasps and the second clasps are identical and are of hermaphroditic mating construction.

20. The nursing garment of claim 1, comprising:
first clasps and second clasps of hermaphroditic mating construction, wherein the first clasps are attached to the outer bodice and face in a same first direction, and wherein the second clasps are attached to the shoulder straps and face in a same second direction opposite the first direction to connect to either of the first clasps.

21. The nursing garment of claim 20, comprising:
the shoulder straps form loops, respectively;
the second clasps are slidable along the loops;
ends of the loops connect to center rails of slide-adjustable buckles; and
the shoulder straps extend through eyes of the slide-adjustable buckle to form the loops.

22. The nursing garment of claim 20, comprising:
the second clasps connect to each other to extend the shoulder straps in a loop behind a neck of a wearer of the nursing garment.

23. The nursing garment of claim 1, comprising:
respective first clasps and respective second clasps of hermaphroditic mating construction, wherein the respective first clasps are attached to the outer bodice and face first directions, respectively, for connection to the respective second clasps;
the respective second clasps are attached to the shoulder straps; and
the shoulder straps twist to face the respective second clasps in second directions, respectively, for connection to respective first clasps.

24. The nursing garment of claim 23, wherein the second clasps connect to each other to extend the shoulder straps in a loop behind a wearer of the nursing garment.

25. The nursing garment of claim 23, comprising:
the shoulder straps form loops, respectively;
the second clasps are slidable along the loops;
ends of the loops connect to center rails of slide-adjustable buckles; and
the shoulder straps extend through eyes of the slide-adjustable buckle to form the loops.

26. The nursing garment of claim 1 wherein the shoulder straps include sling supports connected to the front of the outer bodice to hold the built-in bra up.

27. The nursing garment of claim 26 wherein bottoms of the sling supports are attached to the bodice along bottoms of cups.

28. The nursing garment of claim 26 wherein the sling supports are separate from cups, and separate from underarm sections of the bodice.

29. A nursing garment comprising:
a built-in bra having an outer bodice and an inner panel;
shoulder straps connected to a back of the outer bodice, wherein the shoulder straps include sling supports connected to a front of the outer bodice to hold the built-in bra up; and
the built-in bra is detachable from a detachable connection to each of the shoulder straps in preparation for nursing.

30. The nursing garment of claim 29 wherein bottoms of the sling supports are attached to the front of the outer bodice along bottoms of cups assembled between the outer bodice and inner panel.

31. The nursing garment of claim 29 wherein the sling supports are separate from cups assembled between the outer bodice and the inner panel, and separate from underarm sections of the bodice.

32. A nursing garment comprising:
a built-in bra having an outer bodice and an inner panel;
shoulder straps connected to a back of the outer bodice, and the shoulder straps are connected to a front of the outer bodice, to hold the garment up;
respective first clasps and respective second clasps of hermaphroditic mating construction, wherein the respective first clasps are attached to the outer bodice and face in a same first direction for connection to the respective second clasps, and wherein the respective second clasps are attached to the shoulder straps and face in a same second direction opposite the first direction to connect to either of the respective first clasps; and the built-in bra is detachable from a detachable connection to each of the shoulder straps in preparation for nursing.

33. The nursing garment of claim 32, comprising:

the shoulder straps form loops, respectively;

the second clasps are slidable along the loops;

ends of the loops connect to center rails of slide-adjustable buckles; and the shoulder straps extend through eyes of the slide-adjustable buckle to form the loops.

34. The nursing garment of claim 32, comprising:

the second clasps connect to each other to extend the shoulder straps in a loop behind a neck of a wearer of the nursing garment.

35. A method making a nursing garment, comprising:

knitting an outer bodice and an inner panel inside the outer bodice to provide a built-in bra;

connecting an edge binding to detachable fasteners;

sewing the edge binding to join tops of the outer bodice and the inner panel to connect the built-in bra to the detachable fasteners;

sewing first ends of sling straps to a front of the outer bodice;

connecting second ends of the sling straps to respective nursing clips;

connecting first ends of respective shoulder straps to the respective nursing clips; and connecting second ends of the shoulder straps to a bark of the outer bodice, wherein the detachable portions are each removably attached to at least one of the nursing clips.

36. The method of claim 35, comprising:

knitting a seamless tubular bottom portion; and knitting a junction connecting the seamless tubular bottom portion with the outer bodice and the inner panel.

37. The method of claim 36, comprising:

attaching a lining of the seamless tubular bottom portion to interior of the junction.

38. The method of claim 35, comprising:

attaching first clasps to the back of the outer bodice; and attaching second clasps to the respective shoulder straps, wherein the first clasps and the second clasps are of hermaphroditic mating construction to connect the second clasps either with respective first clasps or with each other.

39. The method of claim 35, comprising:

attaching first clasps to the back of the outer bodice; and attaching second clasps to the respective shoulder straps, wherein the first clasps and the second clasps are of hermaphroditic mating construction to connect the second clasps either with respective first clasps or with each other.

40. The method of claim 35, comprising:

attaching first clasps to the back of the outer bodice;

forming loops in the shoulder straps by connecting ends of the shoulder straps to center rails of slide-adjustable buckles, and extending the shoulder straps through eyes of the second clasps and through the slide-adjustable buckle to form the loops, wherein the second clasps are slidable along the loops, and the first clasps and the second clasps are of hermaphroditic mating construction to connect the second clasps either with respective first clasps or with each other.

41. The nursing garment of claim 3, comprising:

the outer bodice and the inner panel are knitted and are sewn to hold the soft cups in place with stitches.

* * * * *

UNITED STATES PATENT AND TRADEMARK OFFICE

CERTIFICATE OF CORRECTION

PATENT NO. : 8,469,769 B2
APPLICATION NO. : 12/575769
DATED : June 25, 2013
INVENTOR(S) : Hendrickson It is certified that error appears in the above-identified patent and that said Letters Patent is hereby corrected as shown below:

In the Specification

In Column 12

At line 20, please change "18" to --118--.

Signed and Sealed this
Thirty-first Day of December, 2013

Margaret A. Focarino

Margaret A. Focarino
*Commissioner for Patents of the United States Patent and Trademark Office*